US006863616B2

(12) United States Patent
Snyder et al.

(10) Patent No.: US 6,863,616 B2
(45) Date of Patent: Mar. 8, 2005

(54) GOLF SWING TRAINING AID

(76) Inventors: Mike L. Snyder, 415 Welch Dr., Farmersville, TX (US) 75442; Danny L. Hughes, 620 Canyon Dr., Cleburne, TX (US) 76031

( * ) Notice: Subject to any disclaimer, the term of this patent is extended or adjusted under 35 U.S.C. 154(b) by 0 days.

(21) Appl. No.: 10/702,947

(22) Filed: Nov. 6, 2003

(65) Prior Publication Data

US 2004/0097296 A1 May 20, 2004

Related U.S. Application Data

(60) Provisional application No. 60/424,436, filed on Nov. 7, 2002.

(51) Int. Cl.[7] ..... A63B 69/36

(52) U.S. Cl. ..... 473/212; 473/214; 473/226; 473/231

(58) Field of Search ..... 473/212, 207, 473/213, 214, 219, 226, 227, 229, 276, 231, 461, 464

(56) References Cited

U.S. PATENT DOCUMENTS 802,623 A * 10/1905 Camp ..... 473/214
1,137,349 A * 4/1915 Patterson ..... 482/127
1,414,012 A * 4/1922 Flint ..... 473/214
3,637,219 A * 1/1972 Lemon ..... 473/214
4,017,086 A * 4/1977 Washburn ..... 473/212
5,743,805 A * 4/1998 Richter ..... 473/213
6,599,200 B1 7/2003 Kallassy
2003/0178773 A1 * 9/2003 Meyer ..... 273/276
2004/0097296 A1 * 5/2004 Snyder et al. ..... 473/212

* cited by examiner

*Primary Examiner*—Raleigh W. Chiu
(74) *Attorney, Agent, or Firm*—David W. Carstens; Scott L. Harper; Carstens & Cahoon, LLP

(57) ABSTRACT

An aid to improve a golf participant's golf swing for developing an accurate and powerful golf swing technique. The inventive device includes an arm strap assembly, a trigger assembly, a ratchet assembly and a club clip attachment. The arm strap assembly attaches to the player's trailing arm by adjustable straps. The trigger assembly includes a trigger line of fixed length and connects the arm strap to the ratchet assembly. One purpose of this component is to "trigger" the point at which the ratchet mechanism should release the ratchet line. The ratchet assembly consists of a retracting, spring-loaded release device that remains locked as long as the trigger mechanism is slack. Once the trigger mechanism exceeds a preset pull-force, the ratchet mechanism releases allowing the ratchet line connected between the ratchet assembly and the participant's golf club to extend at the appropriate position in the participant's down swing. In turn, this allows the participant to extend his trailing arm resulting in the generation of maximum force to be imparted to the golf ball at the point of impact.

12 Claims, 5 Drawing Sheets

GOLF SWING TRAINING AID

CROSS-REFERENCE TO RELATED APPLICATIONS

This application claims the priority filing date of U.S. Provisional Application, Ser. No. 60/424,436, filed on Nov. 7, 2002, which is incorporated herein by reference.

BACKGROUND OF THE INVENTION

The task of producing a consistent golf swing has been the elusive goal of golfers, both amateur and professional, since the early days of the game. There have been many advancements in golf club and golf ball technology, such as golf clubs with oversize sweet spots that help propel poorly hit golf balls in a straight or intended direction. Golf clubs are now fabricated from titanium and other lightweight materials to provide increased distance. However, despite these technologies, a golfer who lacks a proper, consistent golf swing will continue to mishit the ball and suffer from inaccuracy leading only to frustration in the pursuit of being a good golfer.

An improper golf swing can be found among beginners as well as among seasoned players. The difficulty in learning the correct swing is that it is hard to translate theory into practice. It is quite difficult to perform the intricate steps of the correct swing, partly because the crucial moment within the swing lasts for milliseconds only. The participant may, in other words, not know if he/she is performing the swing correctly. Moreover, teaching a participant the "correct" golf swing is problematic. The teacher may see the problem, but may be unable to make the player correct his/her swing.

The "correct" golf swing has been thoroughly documented over the years. Many professional golfers and golf instructors have written books and articles on the topic. Examples of these references include "Pulling The Arrow Out Of A Quiver" by Davis Love; "In-line Delivery Position", by Jim McLean and "The Magic Move" by Harvey Penick. The key to hitting a golf ball well, is developing a golf swing which allows the player to strike the golf ball with the greatest generated force and as "squarely" as possible. To accomplish this, the participant must perform the entire swing correctly. A key element to the correct swing is to keep the trailing wrist bent during the swing until the point where the club head is within approximately 18 inches of the ball. At that point, the wrists should release and the trailing arm should start to straighten thereby creating a "sling-shot" effect. This will propel the club head to the highest velocity possible just before the impact with the golf ball traveling the maximum distance as a result of the force imparted thereto. The timing of the wrist release not only affects the impact force, it also affects the accuracy: If the release takes place at the incorrect moment in the swing, the club head will impact the ball in the wrong spot resulting in the ball veering of course.

The sequence of actions and elements that comprise a golf swing is affected by many physical factors. For example, the size of the club, the size of the ball, the strength and position of the golfer are all variable factors that affect the distance and trajectory of the golf ball after it is struck with a golf club. These factors considered with the influences of wind, the quality of the lie of the ball, the fatigue and concentration of the golfer, and other variables and conditions make consistent ball striking and delivery quite difficult. While the golfer cannot do anything to affect the influence of the wind, other external factors and other complexities of the game, he or she can, by developing a consistent and repeatable golf swing, consistently control the flight pattern of the ball, its trajectory, the amount of spin or curve, and the distance that the ball travels.

There are numerous elements of a golf swing that have a dynamic influence on the club. These include the alignment of the body at address, the position of the feet, hips, torso and head, the alignment of the arms, the alignment of the hands on the grip, the grip pressure, the relationship of the address position to the ball and the target, the takeaway and subsequent swing plane of the club, the tempo of the swing, the arm extension, the back swing, the subsequent rotation or "coiling" of the body with full shouldered turn, the uncoiling of the body, the weight shift, the downswing, the ball impact, the hand release, the arm extension, the follow-through, the finish and numerous other factors. Accordingly, there is a need for a training device and method of training to assist golfers in the development of proper swing technique and "wrist and arm release" to achieve a consistently repeatable and effective golf swing.

Devices for swing training and teaching proper gripping of a golf club are known in the art, but these devices do not address some of the crucial elements of a "correct" golf swing to be effective. For example, U.S. Pat. No. 3,351,346 (Strahan) discloses a golf swing training device. This swing training device has a bent shaft and weighted end displaced from a golf swing center line with a weight that encircles the shaft and can be adjusted vertically thereon. Strahan's swing training device is used to retrain a golfer to perform an inside-out golf swing thus correcting only a single aspect of the swing. U.S. Pat. No. 4,511,147 (Olsen) discloses a training device with a contoured grip to accommodate a golfer's fingers and to facilitate exact hand positioning. The device is incorporated with a bent shaft and weighted club head. However, this technology can aid only in the appropriate "grip" aspect of the correct golf swing.

These prior patents illustrate prior attempts that have been made to create a golf swing training device that can aid the golfer in his or her attempt to achieve a consistent and proper golf swing and a proper grip. Unfortunately, most, if not all these products require the use of a special training club or floor mat or other device that simply cannot be used when making an actual golf swing and hitting an actual golf ball. As such, none of the prior art can be used while actually hitting golf balls on the practice range or on the course while actually playing golf. While these devices may be suitable for the particular purposes they address, they cannot be used while actually playing or practicing the game. Accordingly, a need exists for a comprehensive swing training device that effectively addresses a full range of golf swing elements for achieving a proper golf swing. Likewise, a need exists for a golf swing training aid that trains the golfer in proper swing technique while utilizing a standard, unmodified club during training.

SUMMARY OF THE INVENTION

The invention disclosed herein consists of an apparatus and associated method which aids in training a golfer to correctly swing a golf club by physically and mechanically manipulating the golfer's arms and wrists into correct positions throughout the golf swing. The present invention prevents the player from "releasing" his or her wrists before the club head strikes the ball, thereby positioning the player's arms, hands and golf club in the appropriate arc for causing the club head to make appropriate contact with the ball resulting in the ball traveling in the desired direction with maximum energy from the correct swing.

The invention generally comprises an arm strap assembly, a trigger assembly, a ratchet assembly and a club clip attachment device. The participant attaches the arm strap assembly to the participant's trailing arm (e.g. the right arm of a right-handed player and vice versa.) The arm strap assembly's upper strap goes around the participant's upper arm, above the elbow, and the lower strap assembly around the participant's lower arm, below the elbow or forearm. The trigger line is then attached to the arm strap assembly and the club clip is connected onto the shaft, below the grip, of the participant's golf club.

The trigger assembly consists of a trigger line comprised of string, cable or other flexible connector of fixed length suitable to maintain tension, which is connected to the arm strap assembly at one end and the ratchet assembly at the other end. The ratchet assembly consists of a spring-loaded release line that remains locked as long as the trigger mechanism is slack. The trigger assembly acts to "trigger" the point at which the ratchet assembly should release the ratchet line thereby allowing the golfer to "break" his/her wrists at the appropriate position during the golf swing. Once the trigger assembly exceeds a preset pull-force, the ratchet assembly releases the ratchet line, thereby allowing the participant to break his/her wrists and fully extend his/her arms creating a "sling-shot" effect that results in maximum force being imparted on the golf ball during contact with the golf club.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Figure 1A:
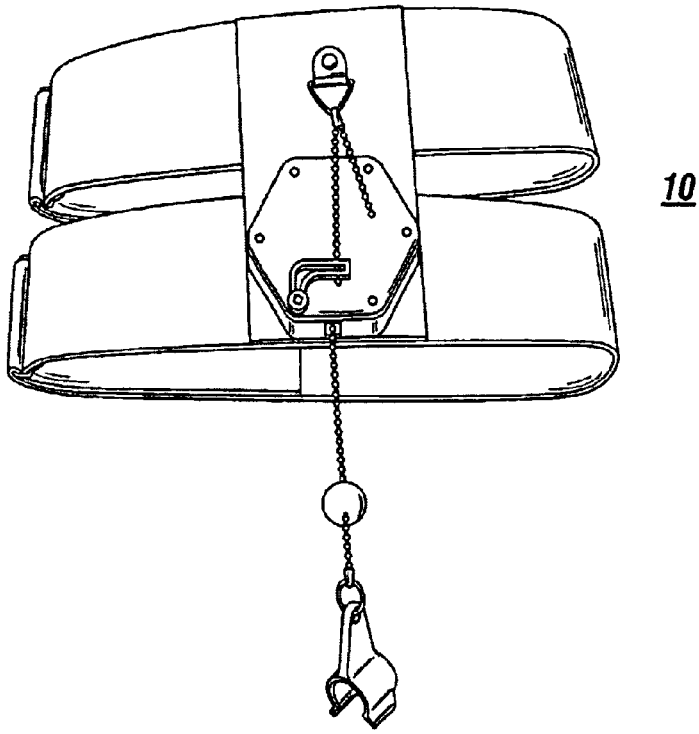
FIG. 1A is a perspective view of the training aid assembly of the present invention depicting the assembled components of same.
Figure 1B:
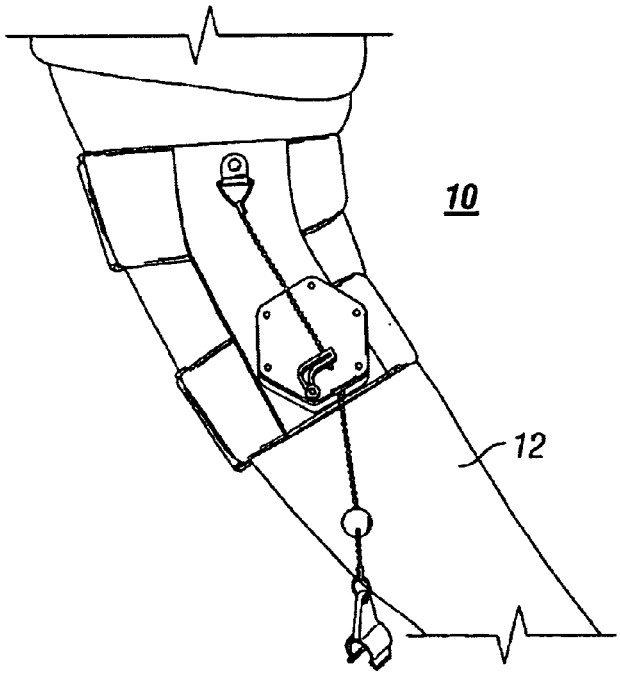
FIG. 1B is a perspective view of the present invention affixed to the golfer's arm.

Turning now to the drawings, FIG. 1A shows the assembled golf swing training aid 10 comprising the invention set forth herein. FIG. 1B shows the golf swing training aid 10 secured around the trailing arm 12 of the participant.

Figure 2A:
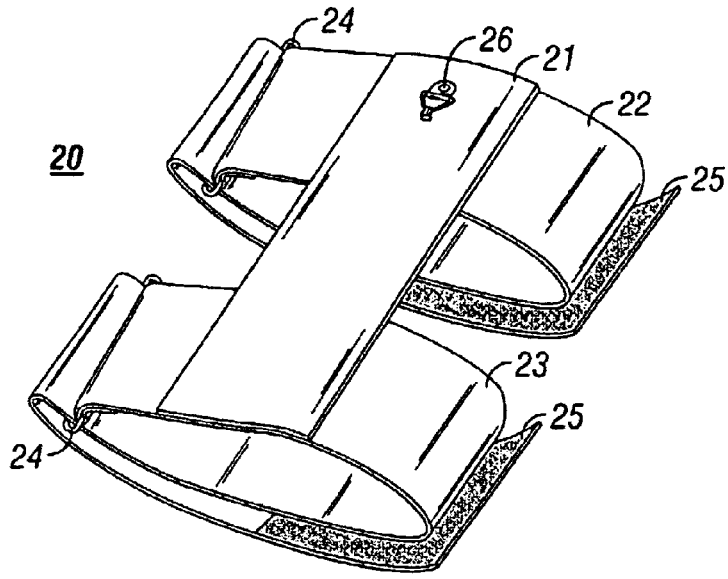
FIGS. 2A and 2B depict the arm strap assembly of the present invention in the closed and open positions, respectively.
Figure 2B:
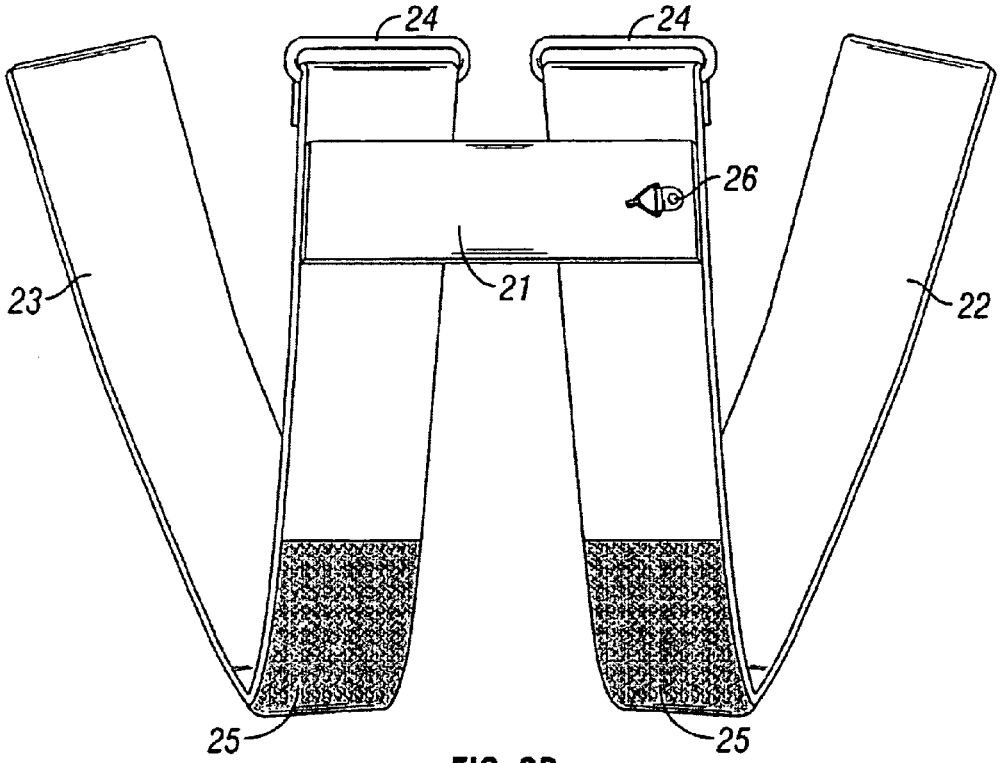

FIG. 2A shows the arm strap assembly 20 in further detail. The arm strap assembly 20 is comprised of an axial strap 21 which is connected at one end to upper strap 22 and at the other end by lower strap 23. Upper strap 22 and lower strap 23 are adjustable by means of adjustment clips 24, so that the training aid 10 may be utilized by different participants with different arm sizes. The training aid 10 is secured to the trailing arm 12 of the participant by securing upper strap 22 and lower strap 23 via hook and loop fasteners 25 or by other fastening means, such as buttons, hooks or snaps, as is known in the art. Trigger line attachment 26 provides a connection for the trigger line discussed in further detail below. The trigger line attachment 26 is fixed to the strap assembly 20 as shown. FIG. 2B is another depiction of the arm strap assembly 20 in the unstrapped position. The axial strap 21, upper strap 22 and lower strap 23 may be fashioned out of nylon, cloth, neoprene and other textile materials as known in the art suitable for the present application. The correct position of the training aid 10 on the participant's trailing arm 12 occurs when the upper strap 22 is secured on the participant's arm, above the elbow, and the lower strap 23 is secured around the participant's forearm, below the participant's elbow.

Figure 3:
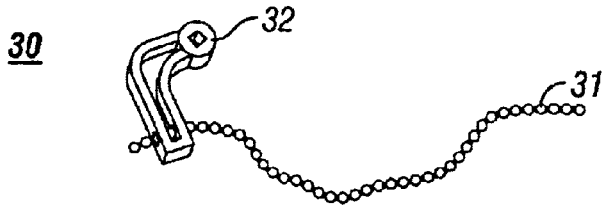
FIG. 3 is a perspective view of the trigger assembly.

FIG. 3 shows the trigger assembly or mechanism 30 consisting of the trigger line 31 and trigger lever 32. Trigger line 31 is of an adjustable, fixed length and secured at one end to trigger lever 32 and at other end to the ratchet assembly 40. The trigger line 31 connects the arm strap assembly 20 to the ratchet assembly 40. The main purpose of the trigger mechanism 30 is to trigger the point at which the ratchet assembly 40 should release. The trigger line 31 may be constructed from string, chain or any other material suitable to maintain tension, without any elongation, equivalent to a pull-force of up to 400 force pounds.

Figure 4A:
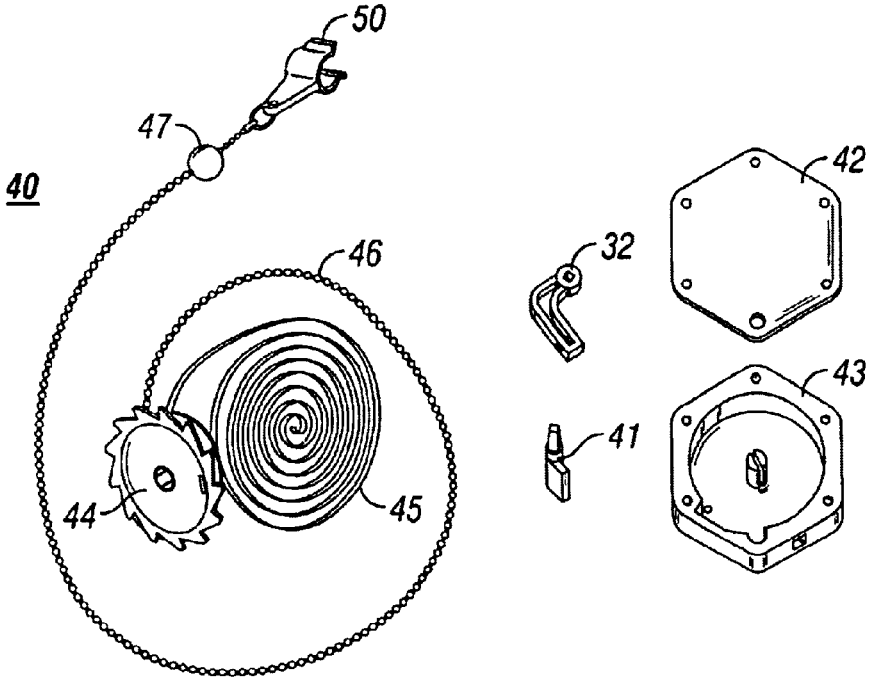
FIG. 4A is an exploded perspective view of the ratchet assembly.
Figure 4B:
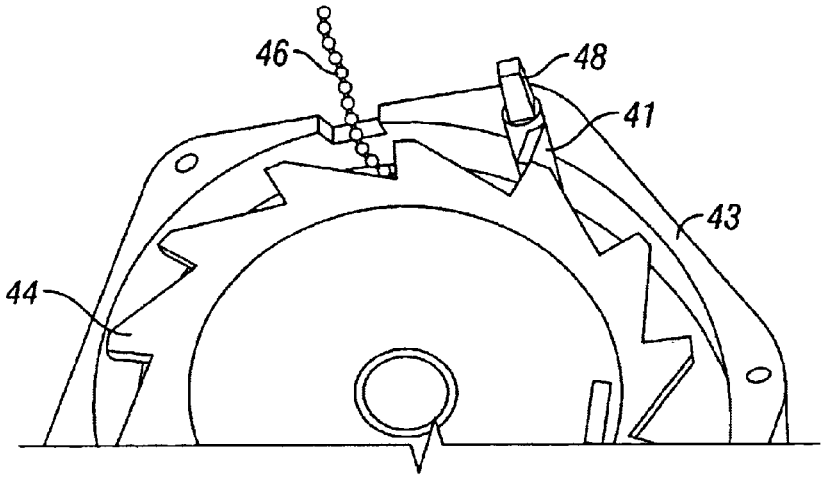
FIG. 4B is a magnified view of the ratchet assembly enclosure.

FIG. 4A shows the components of the ratchet assembly or mechanism 40. The ratchet assembly 40 consists of a spring-loaded release device that remains locked as long as the trigger mechanism 30 is slack. Ratchet assembly 40 includes trigger lever 32, pawl 41, ratchet cover 42, ratchet case 43, ratchet wheel 44, spring 45, ratchet line 46, line stop 47 and golf club clip 48. As shown in FIG. 4B, the pawl 41 is proportionally disposed inside ratchet case 43 and oriented in relation to the teeth of ratchet wheel 44. The distal end 48 of pawl 41 protrudes through ratchet case 43 and provides a connection point for trigger lever 32. Ratchet line 46 is retractably disposed within the ratchet case 43 and may be withdrawn or retracted by the spring force of spring 45. The spring 45 is of the coil type and retracts the ratchet wheel 44 in the "release" direction, the rotating direction in which the pawl 41 does not engage with the ratchet wheel 44. Line stop 47, which is secured to ratchet line 46, prevents the ratchet line 46 from becoming completely withdrawn inside the ratchet assembly 40. The ratchet assembly 40 is a retracting, ratcheting mechanism. Its function is to retract the ratchet line 46 when the ratchet mechanism 40 is in a "non-triggered" state and unlocking the ratchet line 46 when it is in a "triggered state." When the trigger mechanism remains slack, the spring 45 allows the ratchet wheel 44 to retract the ratchet line 46. However, if an attempt to turn the ratchet wheel 44 in the opposite direction is made, for example, when the participant extends his/her trailing arm 12 prematurely, the pawl 41 will become seated in one of the notches on the ratchet wheel 44 resulting in a "locked" mechanism. In its normal, "non-triggered" state, the spring 45 keeps the pawl 41 engaged with a notch in the ratchet wheel 44. During actual operation of the device 10, the distance between the participant's trailing upper arm and forearm changes during the various positions of the golf swing. The resulting tension created in the trigger line 31, as the distance between the participant's upper arm and forearm increases during a golf swing, causes the trigger lever 32 to rotate which, when the pull force exerted on the pawl 41 by the trigger lever 32 exceeds that of the friction force required to keep the pawl 41 engaged in ratchet wheel 44, the pawl 41 disengages from the ratchet wheel 44, resulting in ratchet wheel 44 being released to freely turn and ratchet line 46 being allowed to extend at the beginning of the "break point" during the participant's golf swing.

Figure 5:
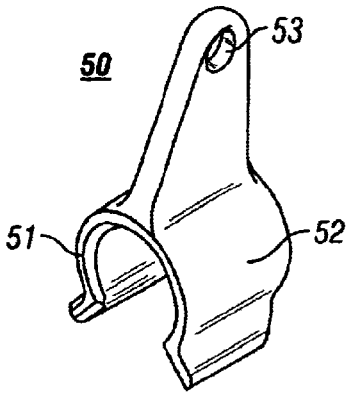
FIG. 5 is a detailed view of the club clip attachment.

Turning to FIG. 5, the club clip 50 is shown. Club clip 50 is made of a one-piece plastic or metal construction including curved opposing sides 51 and 52 and a ratchet line attachment, in this embodiment, depicted as a hole 53. Opposing curved side members 51 and 52 are formed of sufficient arc and diameter so as to slide around the circumference of a standard golf club shaft and provide a connection between the assembly 10 and the golf club utilized by the player. The clip 50 diameter may be larger than the diameter of the golf club shaft as long as it is not larger than that the diameter of the golf club's grip. The clip 50 should be constructed so as to be easily installed and removed, is lightweight and can withstand an approximate pull-force of 400 force pounds without detaching from the participant's golf club.

Figure 6A:
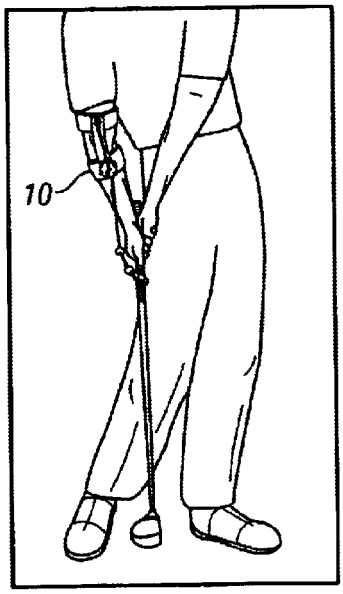
FIGS. 6A–6G are sequential views showing the various positions and mechanics of the present invention during a golf swing as embodied in the present invention.

FIGS. 6A–6G show the training aid 10 (as shown in FIG. 1A) in various positions as the participant makes a golf swing. Referring to FIG. 6A, the participant is aligning the golf club head with the golf ball in order to find the correct foot/body positioning. During this event, the participant's arms are extended which causes the trigger line 31 (as shown in FIG. 3) to become tensile and rotate trigger lever 32 (as shown in FIG. 3) which pulls pawl 41 (as shown in FIG. 4B) from engagement with the ratchet wheel 44 (as shown in FIG. 4B) resulting in a fully released and free-moving ratchet line 46 (as shown in FIG. 4B) with no restraints.

Figure 6B:
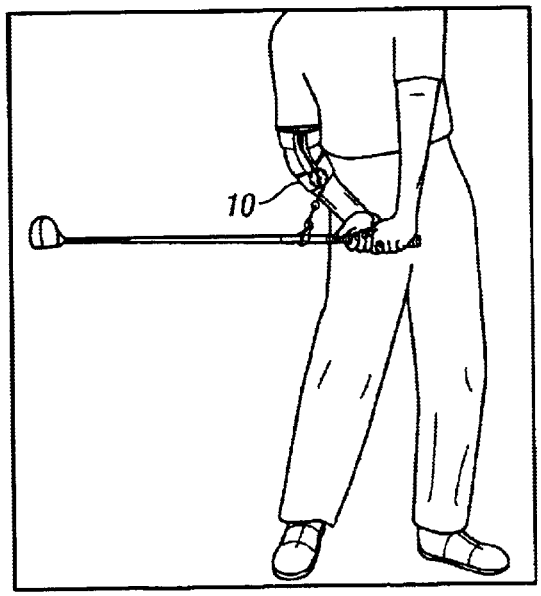

Next, as shown in FIG. 6B, as the participant "winds up" his/her back swing, the distance between the upper arm and forearm of the participant's trailing arm 12 (as shown in FIG. 1B) becomes continuously shorter. This is the natural result of the hands nearing the top of the back swing. Because of this decreasing distance, the trigger line 31 (as shown in FIG. 3) now remains "slack" and the ratchet assembly 40 (as shown in FIG. 4A) will continue to reel in the ratchet line 46 (as shown in FIG. 4B) as the pawl 41 (as shown in FIG. 4B) is now disengaged from the ratchet wheel 44 (as shown in FIG. 4B) in this rotational direction. However, if during the back swing, the participant attempts to release his/her hands, the pawl 41 (as shown in FIG. 4B) will become engaged with ratchet wheel 44 (as shown in FIG. 4B) causing the ratchet assembly 40 (as shown in FIG. 4A) to lock and preventing any extension of ratchet line 46 (as shown in FIG. 4B). In turn, this forces the participant to maintain his/her wrists and trailing arm 12 (as shown in FIG. 1B) in the appropriate position.

Figure 6C:
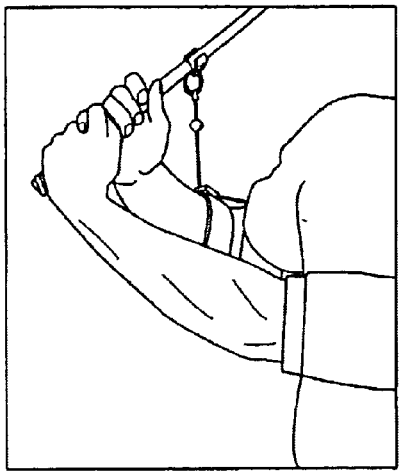

FIG. 6C depicts the participant in the full back swing position. In this position, the trailing arm 12 (as shown in FIG. 1B) hand is in a bent position with most of the ratchet line 46 (as shown in FIG. 4B) reeled into the ratchet assembly 40 (as shown in FIG. 4A). The trigger line 31 (as shown in FIG. 3) remains slack and the spring 45 (as shown in FIG. 4A) forces the ratchet wheel 44 (as shown in FIG. 4B) to retract the ratchet line 46 (as shown in FIG. 4B) during the back swing motion. The participant's body, arms and hands are now properly set up for a correct swing.

Figure 6D:
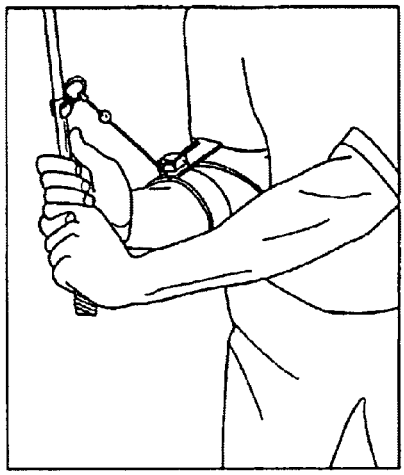

FIG. 6D shows the participant beginning to initiate the down swing of the golf club. The wrist of the trailing arm 12 (as shown in FIG. 1B) has remained bent since the position shown in FIG. 6C as the training aid 10 (as shownh in FIG. 1A) has prevented extension of the ratchet line 46 (as shown in FIG. 4B) as discussed above. In this position, due to the fact that the distance between the player's upper and lower trailing arm has remained short enough to prevent tension in the trigger line 31 (as shown in FIG. 3), the trigger assembly 30 (as shown in FIG. 3) has remained "slack" resulting in a "locked" ratchet assembly 40 (as shown in FIG. 4A). This forces the participant to keep his/her trailing arm 12 (as shown in FIG. 1B) wrist bent and prevents the participant from prematurely extending his/her trailing arm before the appropriate "breaking point."

Figure 6E:
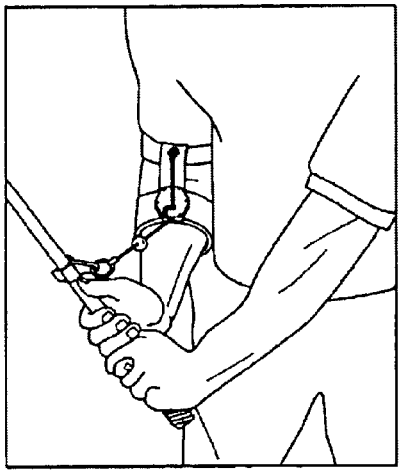

As the down swing progresses, however, the distance between the participant's trailing upper arm and forearm begins to increase. FIG. 6E depicts the appropriate "breaking point" at which a participant should begin to "break" his/her wrists and begin to extend his/her trailing arm 12 (as shown in FIG. 1B) during the golf down swing. The golf club head is now approximately 18 inches away from the ball. This is the precise moment where the participant's wrists and trailing arm 12 (as shown in FIG. 1B) should be allowed to straighten and "release" to maximize the power generated by the participant's golf swing. At this point, the tension created in the trigger line 31 (as shown in FIG. 3), as the distance between the participant's upper arm and forearm increases during the down swing, causes the trigger lever 32 (as shown in FIG. 3) to rotate, in turn, causing the pawl 41 (as shown in FIG. 4B) to disengage from the ratchet wheel 44 (as shown in FIG. 4B), resulting in ratchet wheel 44 (as shown in FIG. 4B) being released and ratchet line 46 (as shown in FIG. 4B) being allowed to extend, along with the participant's wrists and trailing arm 12 (as shown in FIG. 1B), at the beginning of the desired "release" point during the participant's golf swing.

Figure 6F:
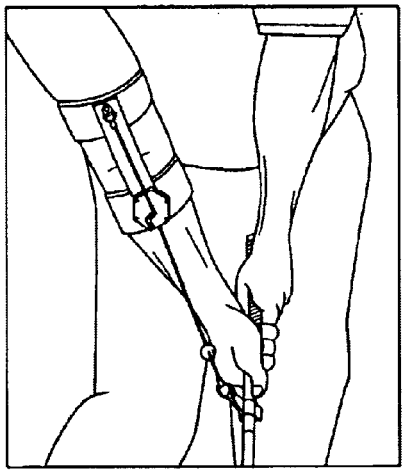

FIG. 6F shows the participant at the "full release point" where the participant is making contact with the ball via the golf club head and is allowed to extend his/her trailing arm 12 (as shown in FIG. 1B) by the training aid 10 (as shown in FIG. 1A). In this position, the trigger line 31 (as shown in FIG. 3) remains in a tensile state, keeping pawl 41 (as shown in FIG. 4B) disengaged, thereby allowing the ratchet wheel 44 (as shown in FIG. 4B) to freely rotate and thus allowing the ratchet line 46 (as shown in FIG. 4B) to extend as required. The wrists of the participant are "straight" and the "sling-shot" effect facilitated by the well-timed release of the participant's trailing arm and wrists has accelerated the club head to its maximum velocity just before impacting the golf ball. The correct timing of the release also ensures that the angle of impact with the ball is in line with its intended direction.

Figure 6G:
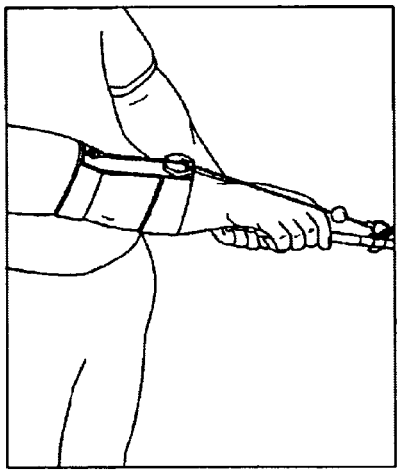

FIG. 6G depicts the "follow through" portion of the participant's golf swing with the ratchet line 46 (as shown in FIG. 4B) in an extended position for the remainder of the follow through. Once the "follow through" portion of the swing is completed, the participant may begin another golf swing. As the distance between the upper arm and forearm portions of the golfer's trailing arm 12 (as shown in FIG. 1B) decreases, the tension in the trigger line 31 (as shown in FIG. 3) diminishes thereby allowing pawl 41 (as shown in FIG. 4B) to reengage with ratchet wheel 44 (as shown in FIG. 4B) resulting in the training aid 10 (as shown in FIG. 1A) entering into an "untriggered" state. This repeatable process allows the participant to repeatedly practice his/her golf swing with the training aid assembly 10 (as shown in FIG. 1A) without the need to reset the assembly 10 (as shown in FIG. 1A) or remove it from the participant's arm 12 (as shown in FIG. 1B) for reuse.

The description of the present invention has been presented for purposes of illustration and description, and is not intended to be exhaustive or limited to the invention in the form disclosed herein. Many modifications and variation will be apparent to those of ordinary skill in the art. The embodiment was chosen to and described in order to best explain principles of the invention, the practical application, and to enable others or ordinary skill in the art to understand the invention for various embodiments with various modifications as are suited to the particular use contemplated.

We claim:

1. A golf swing training aid comprising:

(a) a strap assembly with an upper strap and a lower strap connected by an axial strap;

(b) a trigger assembly attached to the strap assembly; and (c) a ratchet assembly attached to the trigger assembly via a trigger line wherein the ratchet assembly includes an extendible ratchet line whose extension is controlled by the tension present in the trigger line.

2. The training aid of claim 1, further comprising:

(a) a golf club clip attached is attached to the ratchet line.

3. The training aid of claim 1 wherein the upper strap is placed in a position around the participant's upper arm, above the elbow, and the lower strap is positioned on the participant's forearm, below the elbow.

4. The training aid of claim 1 wherein the strap assembly is constructed of nylon.

5. The training aid of claim 1 wherein the trigger assembly comprises a trigger line and a trigger lever.

6. The training aid of claim 1 wherein the ratchet assembly comprises a pawl, a spring, and a ratchet wheel.

7. The training aid of claim 6 wherein a line stop is connected to the ratchet line.

8. A method for training a golfer to develop a mechanically correct golf swing comprising the steps of:

(a) attaching a training aid assembly on the trailing arm of the participant and the shaft of a golf club;

(b) assuming a golf ball address position;

(c) taking the training aid assembly through a back swing motion and retracting a ratchet line precluding extension of the trailing arm of the participant;

(d) taking the training aid assembly through a down swing motion and triggering the release of the ratchet line allowing the extension of the trailing arm of the participant before the club makes contact with the golf ball; and, (e) taking the triggered training aid assembly through a follow-through motion.

9. The method of claim 8 wherein steps (a) through (e) may be repeated indefinitely without the need to manually reset the training aid assembly.

10. The method of claim 8 wherein the training aid assembly remains untriggered during the back swing motion.

11. The method of claim 8 wherein the training aid assembly is triggered to release the ratchet line before the golf club makes contact with the golf ball.

12. The method of claim 8 wherein the training aid assembly automatically returns to an untriggered position when the back swing motion is repeated.

* * * * *